US005180945A

United States Patent [19]

Kweon

[11] Patent Number: 5,180,945

[45] Date of Patent: Jan. 19, 1993

[54] ELECTRON GUN FOR CATHODE RAY TUBE

[75] Inventor: Yong-geol Kweon, Seoul, Rep. of Korea

[73] Assignee: Samsung Electron Devices Co., Ltd., Kyunggi-do, Rep. of Korea

[21] Appl. No.: 814,814

[22] Filed: Dec. 31, 1991

[30] Foreign Application Priority Data

Mar. 14, 1991 [KR] Rep. of Korea ..... 91-3426

[51] Int. Cl.[5] ..... H01J 29/46; H01J 29/56

[52] U.S. Cl. ..... 315/14; 313/414

[58] Field of Search ..... 315/14, 15; 313/414

[56] References Cited

U.S. PATENT DOCUMENTS 4,542,320 9/1985 Suzuki et al. ..... 315/15

*Primary Examiner*—Theodore M. Blum

*Attorney, Agent, or Firm*—Leydig, Voit & Mayer

[57] ABSTRACT

An electron gun for a cathode ray tube comprises a triode having a control electrode and a screen electrode. Each electrode has a number of beam passing holes. The diameter of the beam passing holes of the control electrode is greater than the diameter of the beam passing holes of the screen electrode. Accordingly, spherical aberrations of cathode and prefocusing lenses are decreased, thereby improving image resolution.

3 Claims, 2 Drawing Sheets

ELECTRON GUN FOR CATHODE RAY TUBE

BACKGROUND OF THE INVENTION

The present invention relates to a cathode ray tube, and particularly to an electron gun for emitting an electron beam, which is mounted in the neck of a funnel.

Generally, a cathode ray tube illustrated in FIG. 1 is formed such that a panel 3 having a shadow mask frame assembly 2 mounted in the inside thereof is joined together with a funnel 4 holding an electron gun 5 in a neck 4*a* at the end of the funnel. An electron beam emitted from electron gun 5 passes through a deflection region and the aperture of a shadow mask 2*a*, and then lands on the screen, so that a pixel is formed, and an image is formed by the accumulation of such pixels. A smaller beam spot diameter formed by the above process is favorable to improve the resolution of the image. To further enhance the image's resolution while decreasing the size of the beam spot, the influence of spherical aberration on the electron beam caused by an electron lens should be minimized. If spherical aberration greatly affects the electron beam, a spot halo of a considerable size is formed around the beam spot, thereby adversely affecting the resolution.

FIG. 2 illustrates an example of a conventional in-line type electron gun with a single electrostatic lens. The electron gun 10 has a triode consisting of a cathode 11, a control electrode 12, and a screen electrode 13 which are for generating an electron beam, and a main lens consisting of a focus electrode 14 and an anode 15, for focusing and accelerating the electron beam generated from the triode. Three electron beam passing holes are formed in each electrode of the electron gun, and the central axes of all the electrodes' electron beam passing holes are positioned on substantially the same plane. The diameters of electron beam passing holes 12H and 13H formed in control electrode 12 and screen electrode 13, respectively, are smaller than those of electron beam passing holes 14H and 15H formed in focus electrode 14 and anode 15 constituting the main lens. Generally, the diameter of electron beam passing hole 12H formed in control electrode 12 is smaller than that of electron beam passing hole 13H formed in screen electrode 13.

In the conventional electron gun 10 for the conventional cathode ray tube constructed as above, electron lenses are formed between respective electrodes when a certain voltage is applied to each electrode. A cathode lens C is formed in control electrode 12 supplied with a relatively low voltage potential. A prefocusing lens P for the initial focusing and accelerating of the electron beam is formed between screen electrode 13 of a lower potential and focus electrode 14 supplied with a relatively high potential. Main lens M for the final focusing and accelerating of the electron beam is formed between focus electrode 14 and anode 15 supplied with the highest voltage potential. Accordingly, thermoelectrons are emitted from cathode 11, and the emitted thermoelectrons B are transformed into an electron beam while passing through cathode lens C. The electron beam is preliminarily focused and accelerated while passing through prefocusing lens and is finally focused and accelerated while passing through main lens M, and proceeds to screen 30.

In the conventional electron gun 10 having the above-described structure, since electron beam passing hole 12H of control electrode 12 is smaller than electron beam passing hole 13H of screen electrode 13, electron beam B emitted from cathode 11 passes through the whole region of cathode lens C formed by an electron beam passing hole of a smaller diameter. Therefore, the electron beam formed by having passed through cathode lens is under the influence of spherical aberration from the cathode lens, thereby being incident to main lens M with a large diverging angle. Then, the electron beam incident to the main lens passes through the whole region of the main lens, from its center to the periphery, so that the incident electron beam comes under great spherical aberration influence. As a result, when the electron beam greatly affected by spherical aberration reaches the screen, a beam spot having a halo somewhat darker than the center and of considerable size, forms around its bright core.

SUMMARY OF THE INVENTION

It is the object of the present invention to provide an electron gun for a color cathode ray tube, of which the structure is improved to decrease the influence of spherical aberration on the electron beam caused by an electron lens, thereby enabling an image with improved resolution by realizing a beam spot of good quality.

To achieve the object, there is provided an electron gun for a cathode ray tube comprising a cathode for generating thermoelectrons, a sequentially arranged control electrode and screen electrode having three in-line type electron beam passing holes in their bodies for transforming the thermoelectrons emitted from the cathode into an electron beam, and a focus electrode and an anode for the finally focusing and accelerating of the generated electron beam, wherein an electron beam passing hole in the central electrode adjacent to the cathode is larger than an electron beam passing hole in the screen electrode, thereby enlarging the diameter of a cathode lens formed by the control electrode.

BRIEF DESCRIPTION OF THE DRAWINGS

These and other objects, features, aspects and advantages of the present invention will become more apparent from the following detailed description of the present invention when taken in conjunction with the accompanying drawings, in which.

DETAILED DESCRIPTION OF THE INVENTION

Figure 1:
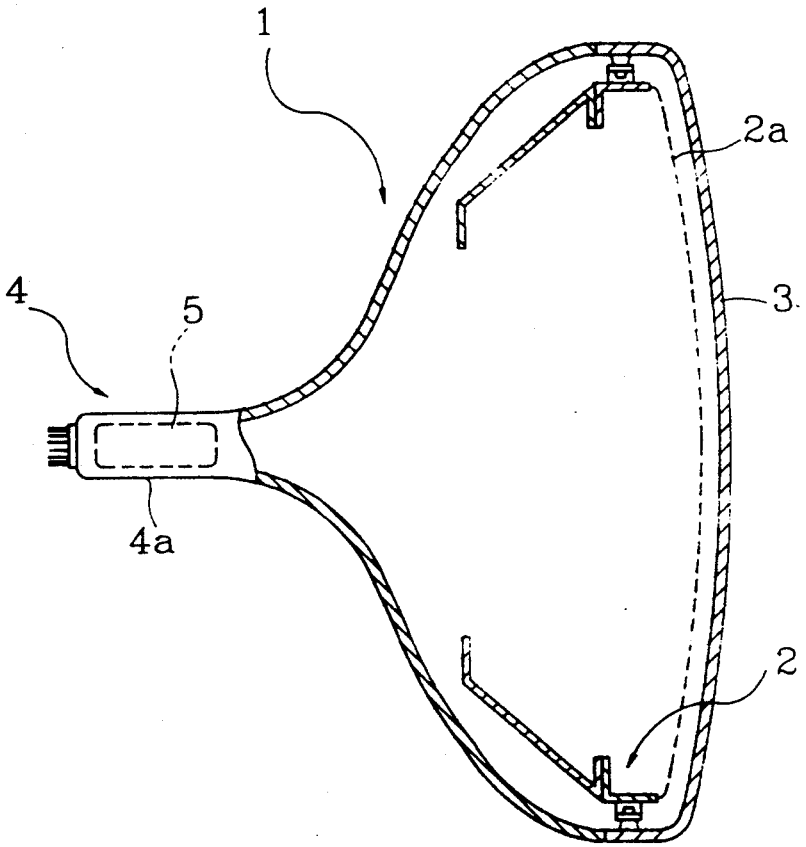
FIG. 1 (PRIOR ART)
FIG. 1 is a sectional view of a color cathode ray tube having a conventional in-line type electron gun.
Figure 2:
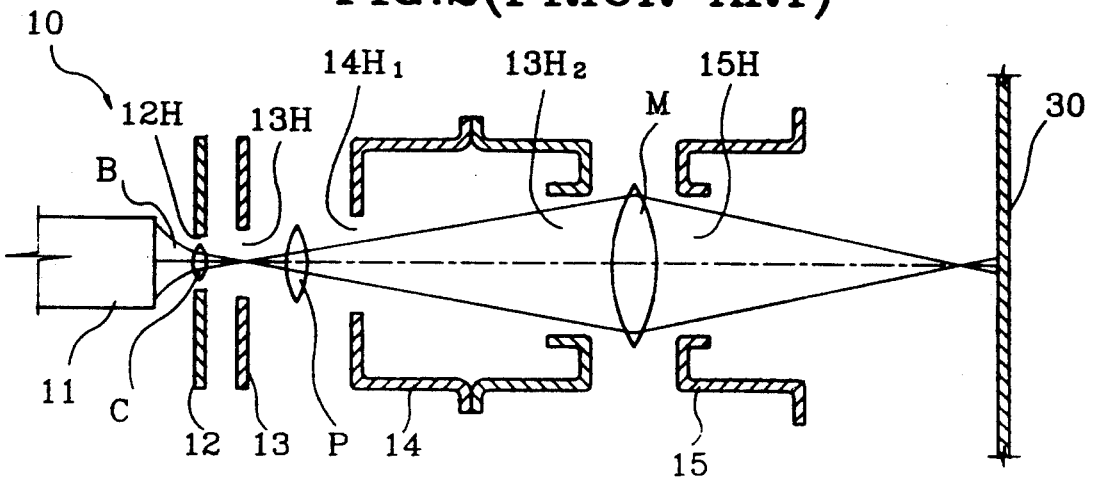
FIG.2(PRIOR ART)
FIG. 2 is a schematic sectional view showing the electron gun of a conventional cathode ray tube, which shows the electron beam's tracing.
Figure 3A:
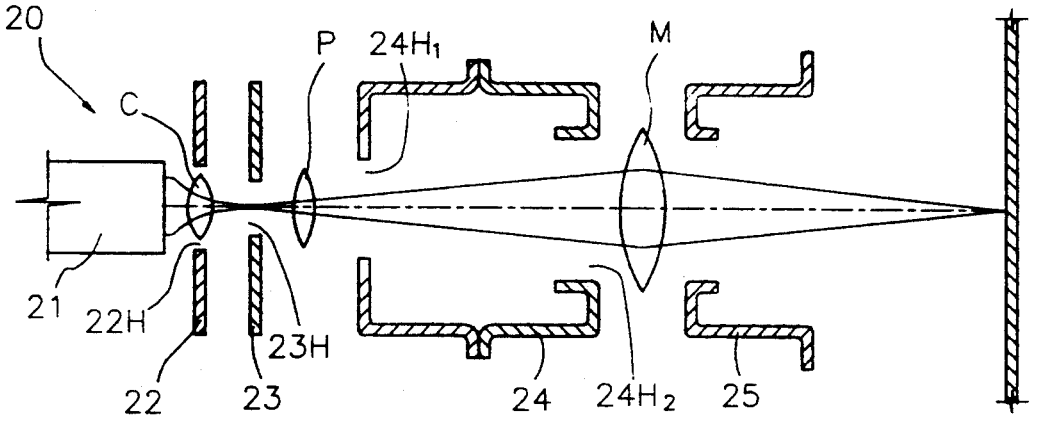
FIG. 3A is a schematic sectional view showing an electron gum of a cathode ray tube according to the present invention, which shows the electron beam's tracing.
Figure 3B:
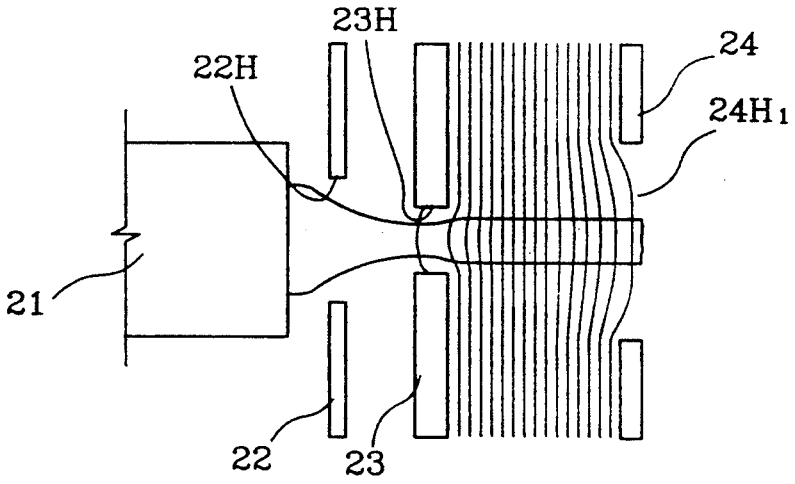
FIG. 3B is an exploded view of the triode shown in FIG. 3A, for generating the electron beam in an electron gun of a cathode ray tube according to the present invention.

As illustrated in FIG. 3A, an electron gun 20 for a cathode ray tube according to the present invention comprises a triode consisting of a cathode 21, a control electrode 22, and a screen electrode 23, and a main lens consisting of a focus electrode 24 and an anode 25 for accelerating and focusing generated electron beam. Three in-line type electron beam passing hole are arranged in each electrode, in which the centers of all the electrodes' electron beam passing holes are placed on substantially the same plane.

In accordance with the characteristics of the present invention, the control electrode has an electron beam passing hole 22H of a larger diameter than that of the screen electrode 23. The diameter of electron beam passing hole 22H formed in control electrode 22 is approximately 0.7 mm, and that of an electron beam passing hole 23H formed in screen electrode 23 is 0.6 mm. In focus electrode 24, the diameter of incident electron beam passing hole 24H1 is 1.53 mm, that of outgoing electron beam passing hole 24H2 is 4.1 mm, and that of anode 25 is 4.1 mm.

In the electron gun having the above-described structure according to the present invention, cathode 21 for emitting thermoelectrons is supplied with a voltage of about 100 V to 150 V, screen electrode 23 is supplied with a voltage of 400 V to 800 V, and control electrode 22 forming cathode lens C is supplied with a ground potential. Anode 25 is supplied with a voltage of 20 to 45 Kv, and a voltage of 20 to 40% of the voltage applied to the anode, i.e., 4 KV to 16 KV, is applied to the focus electrode preceding the anode.

In electron gun 20 for a cathode ray tube constructed as above, the electron beam is generated between control electrode 22 and screen electrode 23, and between screen electrode 23 and focus electrode 24. Also, cathode lens C and prefocusing lens P are formed for preliminarily focusing and accelerating the beam. The electron beam preliminarily focused and accelerated by having passed through cathode lens C and prefocusing lens P is finally focused and accelerated by main lens M formed between focus electrode 24 and anode 25, and then lands on the screen of the cathode ray tube. Since electron beam passing hole 22H of control electrode 22 is larger than electron beam passing hole 23H of screen electrode 23 in the electron gun of the present invention, the electron beam passes through a cathode lens which has a relatively large diameter formed in control electrode 22. Therefore, the electron beam is less affected by spherical aberration. Also, the incident angle to main lens M is decreased as compared with the conventional one. Notably, since electron beam passing hole 22H of control electrode 22 is larger than electron beam passing hole 23H of screen electrode 23, and the intensity of cathode lens C formed between them, i.e., the magnification, becomes weak causing the crossover point of the electron beam emitted from cathode 21 and passing through cathode lens C to be distanced from cathode 21. Thus, both the diverging angle of the electron beam having passed through cathode lens C and prefocusing lens P, and the incident angle to main lens M become small. As a result, the electron beam is less affected by spherical aberration while passing through main lens M, thereby forming a beam spot of good quality when it reaches the screen of the cathode ray tube.

According to experiments carried out by this applicant, when the electron beam passing hole 22H of control electrode 22 is formed so as to be larger than electron beam passing hole 23H of screen electrode 23, the diverging angle, of the main lens which is conventionally 4°–5.5°, can be decreased to 3°–4°.

As described above, in the electron gun for the cathode ray tube of the present invention, the influence of spherical aberration on an electron beam is reduced by decreasing the diverging angles of cathode lens, prefocusing lens and main lens, thereby realizing an image of good quality.

What is claimed is:

1. An electron gun for a cathode ray tube, comprising:

a cathode for generating thermoelectrons; 'a sequentially arranged control electrode and screen electrode each having three in-line type electron beam passing holes, for transforming the thermoelectrons emitted from said cathode into an electron beam; and a focus electrode and an anode for initially focusing and accelerating said generated electron beam, wherein a diameter of the electron beam passing holes of said control electrode, said screen electrode and an incident side of said focus electrode are 0.7 mm, 0.6 mm and 1.53 mm, respectively, while a diameter of the electron beam passing holes of an outgoing side of said focus electrode and a diameter of the electron beam passing holes of said anode are about 4.1 mm.

2. An electron gun for a cathode ray tube as claimed in claim 1, wherein said cathode is supplied with a voltage of about 100 V to 150 V, said control electrode is supplied with a ground potential, said screen electrode is supplied with a voltage of about 400 V to 800 V, said focus electrode is supplied with a voltage of about 4 KV to 16 KV, and said anode is supplied with a voltage of about 20 KV to 40 KV.

3. An electron gun for a cathode ray tube, comprising:

a cathode for generating thermoelectrons; 'a sequentially arranged control electrode and screen electrode, said control electrode having a plurality of in-line type electron beam passing holes of a preselected diameter and said screen electrode having a plurality of in-line type electron beam passing holes of a preselected diameter, said control electrode and said screen electrode transforming the thermoelectrons emitted from said cathode into an electron beam; and a focus electrode having a first surface with a plurality of in-line type electron beam passing holes of a first diameter and a second surface with a plurality of in-line type electron beam passing holes of a second diameter, the diameter of the beam passing holes of said screen electrode and the diameter of the beam passing holes of the first surface of said focus electrode having a ratio of 60:153.

* * * * *